US006471560B2

(12) United States Patent
Kerckhoff

(10) Patent No.: US 6,471,560 B2
(45) Date of Patent: Oct. 29, 2002

(54) SURF LEASH AND METHOD OF MAKING SURF LEASH

(76) Inventor: Stephen T. Kerckhoff, 5249 Shelley Pl., Carlsbad, CA (US) 92008

( * ) Notice: Subject to any disclaimer, the term of this patent is extended or adjusted under 35 U.S.C. 154(b) by 0 days.

(21) Appl. No.: 09/758,619

(22) Filed: Jan. 10, 2001

(65) Prior Publication Data

US 2002/0090870 A1 Jul. 11, 2002

(51) Int. Cl.[7] ..... B63B 1/00
(52) U.S. Cl. ..... 441/75
(58) Field of Search ..... 441/74, 75; 119/769, 119/770, 771; 128/878, 882

(56) References Cited

U.S. PATENT DOCUMENTS 3,931,656 A * 1/1976 Thomson ..... 441/75
4,044,415 A * 8/1977 Wood ..... 441/75
4,479,785 A * 10/1984 Tugwood et al. ..... 441/75
4,545,772 A * 10/1985 Stockhausen ..... 441/75
4,596,348 A * 6/1986 Stamp ..... 280/770
4,610,634 A 9/1986 Kimura
4,707,863 A * 11/1987 McNeal ..... 2/436
4,775,345 A * 10/1988 Gifford ..... 441/75
4,905,713 A * 3/1990 Morante ..... 128/878
5,098,324 A * 3/1992 Isono et al. ..... 441/75
5,194,026 A * 3/1993 Corwin et al. ..... 441/75
5,643,028 A * 7/1997 Craig ..... 441/75
5,660,136 A * 8/1997 Pignatelli et al. ..... 114/361
5,779,510 A * 7/1998 Skedelski ..... 441/75
5,799,654 A * 9/1998 Kassan ..... 128/869
6,000,979 A * 12/1999 Stewart ..... 441/75

* cited by examiner

*Primary Examiner*—S. Joseph Morano
*Assistant Examiner*—Andrew Wright
(74) *Attorney, Agent, or Firm*—Stetina Brunda Garred & Brucker

(57) ABSTRACT

A surf leash that does not damage the surfboard and a method for making the surf leash are disclosed. The surf leash includes a cushioned board strap, an ankle strap, and a connection piece that connects the cushioned board strap to the ankle strap. The ankle strap may also be cushioned. The cushioned components are made of a heat pressed strip that includes multiple cushions. Preferably, the board strap and ankle strap are adjustable.

8 Claims, 5 Drawing Sheets

SURF LEASH AND METHOD OF MAKING SURF LEASH

BACKGROUND OF THE INVENTION

The present invention generally relates to a leash and more particularly to a leash for a surfboard and a method of making the surfboard leash.

Leashes are used in order to prevent the loss of an object. For example, a surf leash may be used to prevent the loss of a surfboard. As shown in FIG. 1, a surf leash is attached to a surfboard on one end and to the ankle of the surfer on the other end. Thus, if the surfer falls off of the surfboard, the surfboard will remain in close proximity to the surfer.

FIG. 2 illustrates an exemplary prior art surf leash. The surfboard includes a recessed cup that is flush with the surfboard deck. The surf leash shown in FIG. 2 is made of webbing. Surf leashes such as the one shown in FIG. 2 may cause damage to the surfboard over time due to the webbing strap rubbing against the surfboard as shown in FIG. 2. Furthermore, such surf leashes are attached to the surfboard via a knotted string. Thus, it is difficult to remove the surf leash from the surfboard.

Thus, a need exists for a surf leash that does not damage the surfboard. The surf leash should also be easily detachable from the surfboard.

BRIEF SUMMARY OF THE INVENTION

The present invention is directed to a surf leash and a method of making the surf leash. The surf leash components (board strap and ankle strap) are cushioned.

In accordance with the present invention, a cushioned board strap comprises a cushioned strap member, wherein the cushioned strap member has a first end and a second end opposite the first end and a plurality of heat pressed cushions; and a connection device, wherein the connection device is connected to the cushioned strap member at the first end of the cushioned strap member.

In accordance with other aspects of the invention, the board strap member comprises a board fastening device, wherein the board fastening device is connected to the second end of the cushioned strap member.

In accordance with still other aspects of the invention, the board strap further comprises an adjustable strap, wherein the board fastening device is attached to the cushioned strap member via the adjustable strap.

In accordance with yet other aspects of the invention, the adjustable strap of the board strap member may employ a hook and loop connector. The cushioned strap member of the board strap may be made of a polymer cell foam material or a rubber material, such as neoprene.

In accordance with further aspects of the invention, a cushioned ankle strap comprises a cushioned strap member, wherein the cushioned strap member has a first end and a second end opposite the first end and a plurality of heat pressed cushions; and an adjustment strap, wherein the adjustment strap attaches the first end to the second end in a circular shape, wherein the adjustment strap can alter the circumference of the cushioned strap member.

In accordance with still further aspects of the invention, the cushioned strap member of the cushioned ankle strap may be made of a polymer cell foam material or a rubber material, such as neoprene. The adjustment strap of the ankle strap may employ a hook and loop connector.

In accordance with other aspects of the invention, a surf leash comprises a cushioned board strap, an ankle strap, and a connection piece that connects the cushioned board strap to the ankle strap.

In accordance with yet other aspects of the invention, the ankle strap is a cushioned ankle strap.

In accordance with still other aspects of the invention, the cushioned board strap may be made of a polymer cell foam material or a rubber material, such as neoprene. The cushioned ankle strap may be made of a polymer cell foam material or a rubber material, such as neoprene.

In accordance with further aspects of the invention, a surf leash component is made by: placing a surf leash connection piece on a heat pressed cushioned strip; folding the heat pressed cushion strip around the surf leash connection piece such that the surf leash connection piece protrudes from the folded heat pressed cushion strip; securing the folded heat pressed cushion strip in its folded configuration; and affixing an adjustable strap to the folded heat pressed cushion strip.

In accordance with still further aspects of the invention, the surf leash component is a board strap or an ankle strap. If the surf leash component is a board strap, a board fastening device may be attached to the adjustable strap.

In accordance with yet further aspects of the invention, the heat pressed cushioned strip is made of a polymer cell foam material or a rubber material, such as neoprene. The adjustable strap may employ a hook and loop connector.

BRIEF DESCRIPTION OF THE SEVERAL VIEWS OF THE DRAWING

These as well as other features of the present invention will become more apparent upon reference to the drawings wherein.

DETAILED DESCRIPTION OF THE INVENTION

The present invention is directed to a surf leash which does not damage the surfboard. The surf leash of the present invention reduces pressure on the surfboard by extending the dimensions of the board strap portion of the surf leash. The present invention absorbs pressure and force by providing a pillowed cushion as shown in the figures and described in further detail below. Additionally, the surf leash of the present invention can easily be detached from the surfboard.

Figure 1:
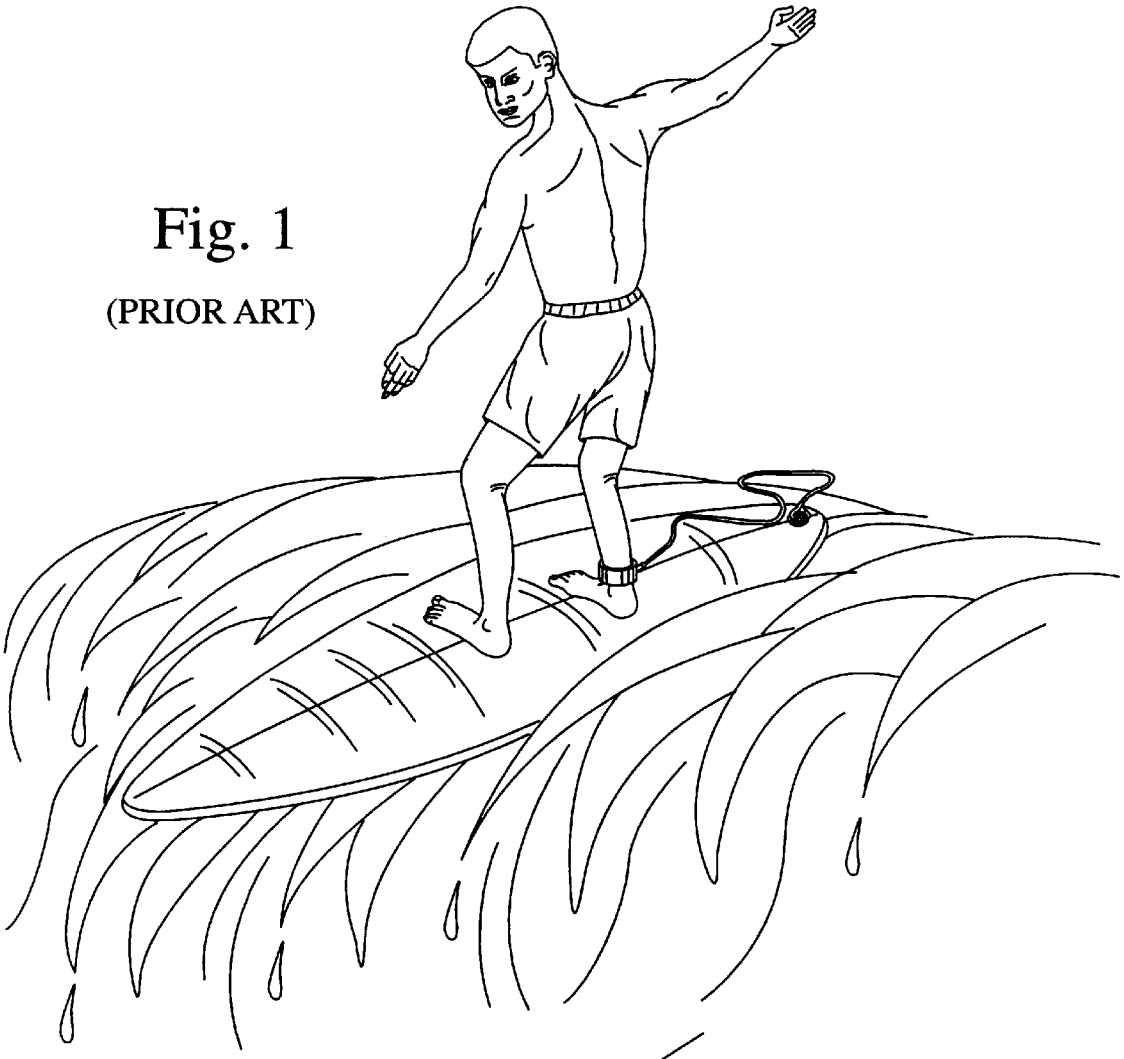
Fig. 1 (PRIOR ART)
FIG. 1 is an exemplary illustration of a surfer using a surf leash.
Figure 2:
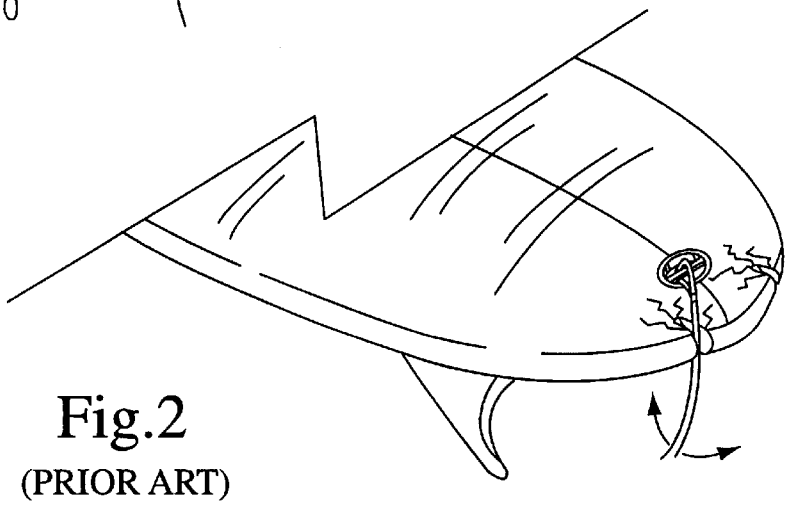
Fig.2 (PRIOR ART)
FIG. 2 is an exemplary illustration showing how a prior art surf leash can damage a surfboard.

Referring now to the drawings wherein the showings are for purposes of illustrating a preferred embodiment of the present invention only, and not for purposes of limiting same, FIG. 1 is an exemplary illustration of a surfer surfing with a surf leash attached to the surfboard and to the surfer. The surfboard has a plug or cup that is recessed with an attachment for the board strap. The recessed cup is glassed into the surfboard when the surfboard is manufactured. One end of the surf leash of the present invention is attached to the plug. The opposite end of the surf leash is attached to the surfer's ankle.

Figure 8:
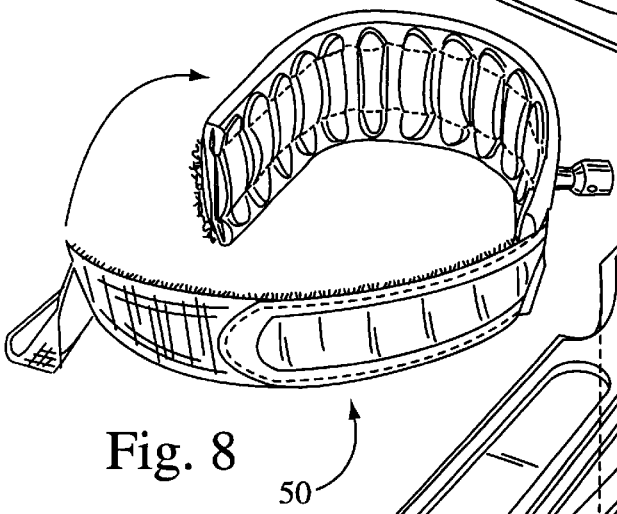
FIG. 8 is a perspective view of an ankle strap portion of a surf leash in its operative condition formed in accordance with the present invention.
Figure 12:
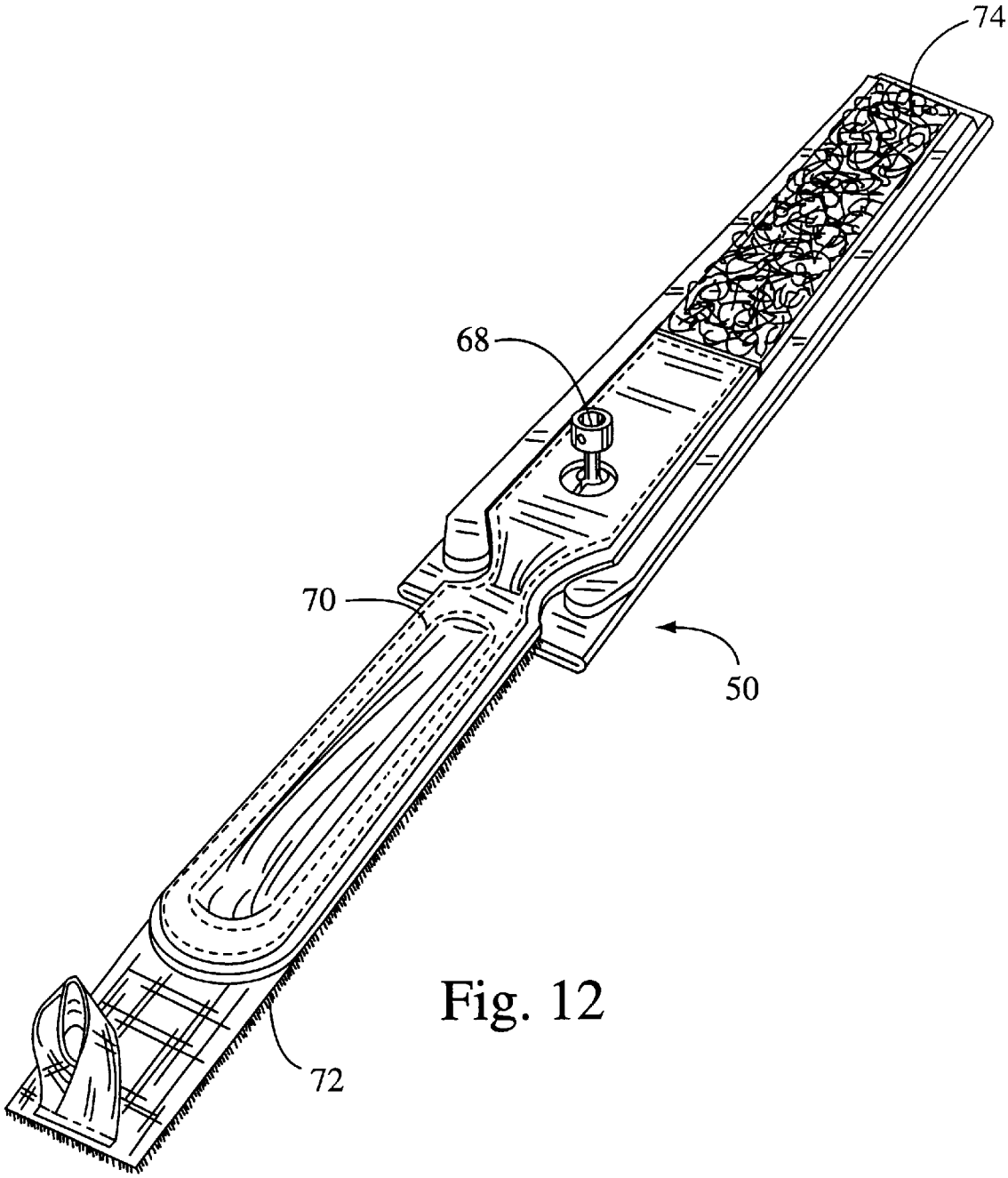
FIG. 12 is a perspective view of the ankle strap portion of the surf leash shown in FIG. 8 shown in its extended condition.

The surf leash of the present invention includes a board strap portion 20 (shown in FIGS. 3 and 7) and an ankle strap portion 50 (shown in FIGS. 8 and 12). The board strap portion 20 and ankle strap portion 50 are connected to each other, for example, with tubing.

The board strap portion 20 of the present invention is manufactured of a soft material which absorbs pressure and prevents damage to the surfboard. Preferably, the board strap portion 20 is constructed to create a pillow-like cushion using a heat press process as described later. Preferably, the board strap portion 20 is primarily made of a polymer cell foam material or a rubber material, such as neoprene. The inside of the polymer cell foam material is foam-like and provides a cushioning effect and the outside is a waterproof fabric which can be any color, for example a color to match the surfboard or a wetsuit.

Figure 3:
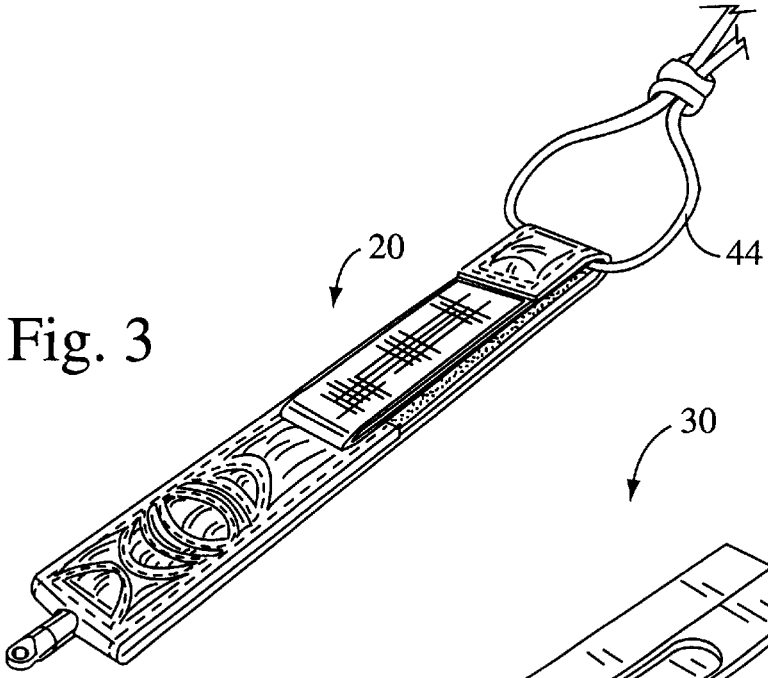
FIG. 3 is a top perspective view of a board strap portion of a surf leash formed in accordance with the present invention.
Figure 4:
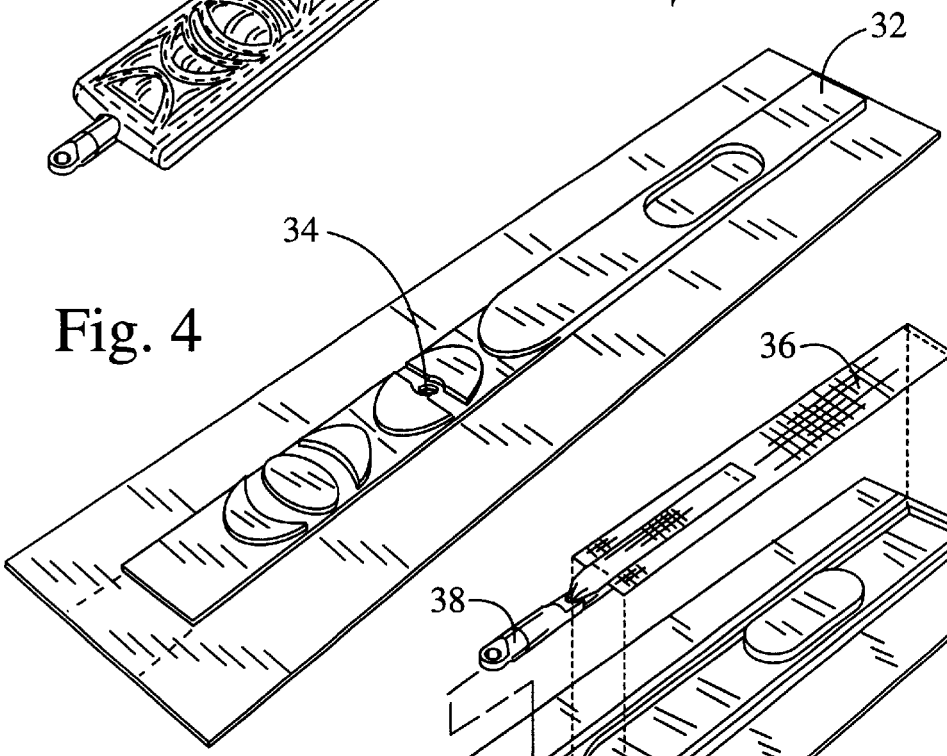
FIGS. 4–6 illustrate steps in making the board strap portion of the surf leash shown in FIG. 4.
Figure 5:
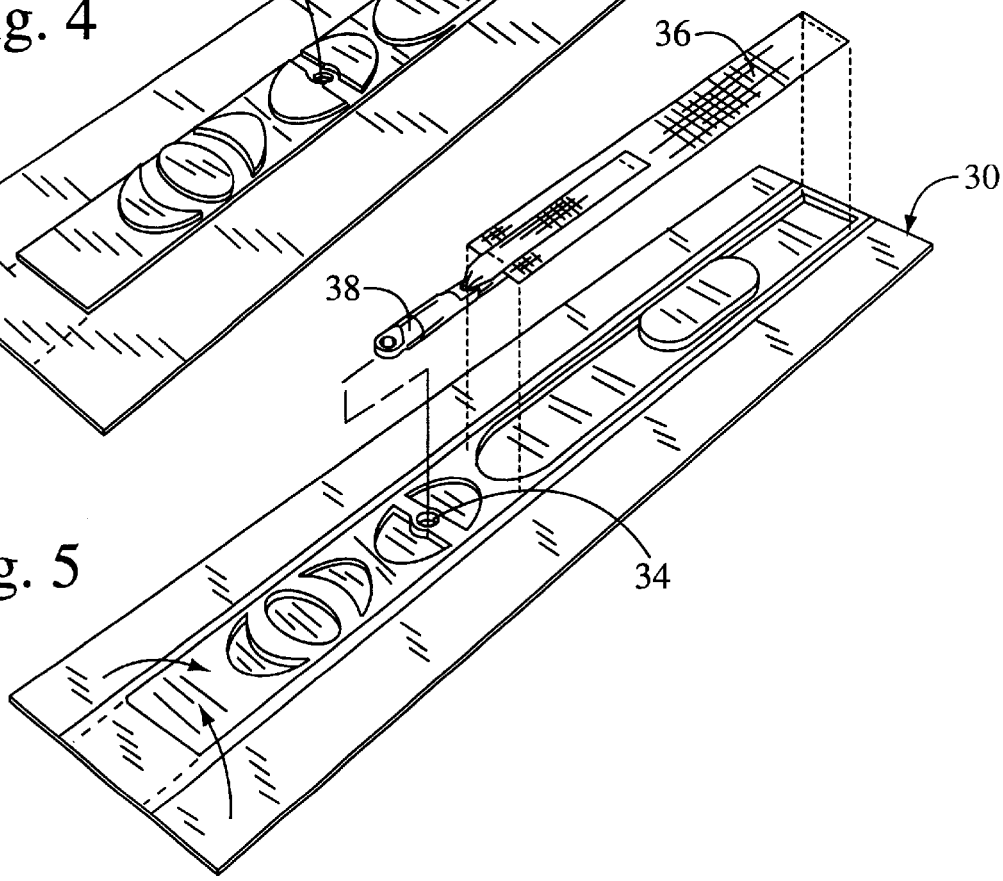
Figures 6, 7:
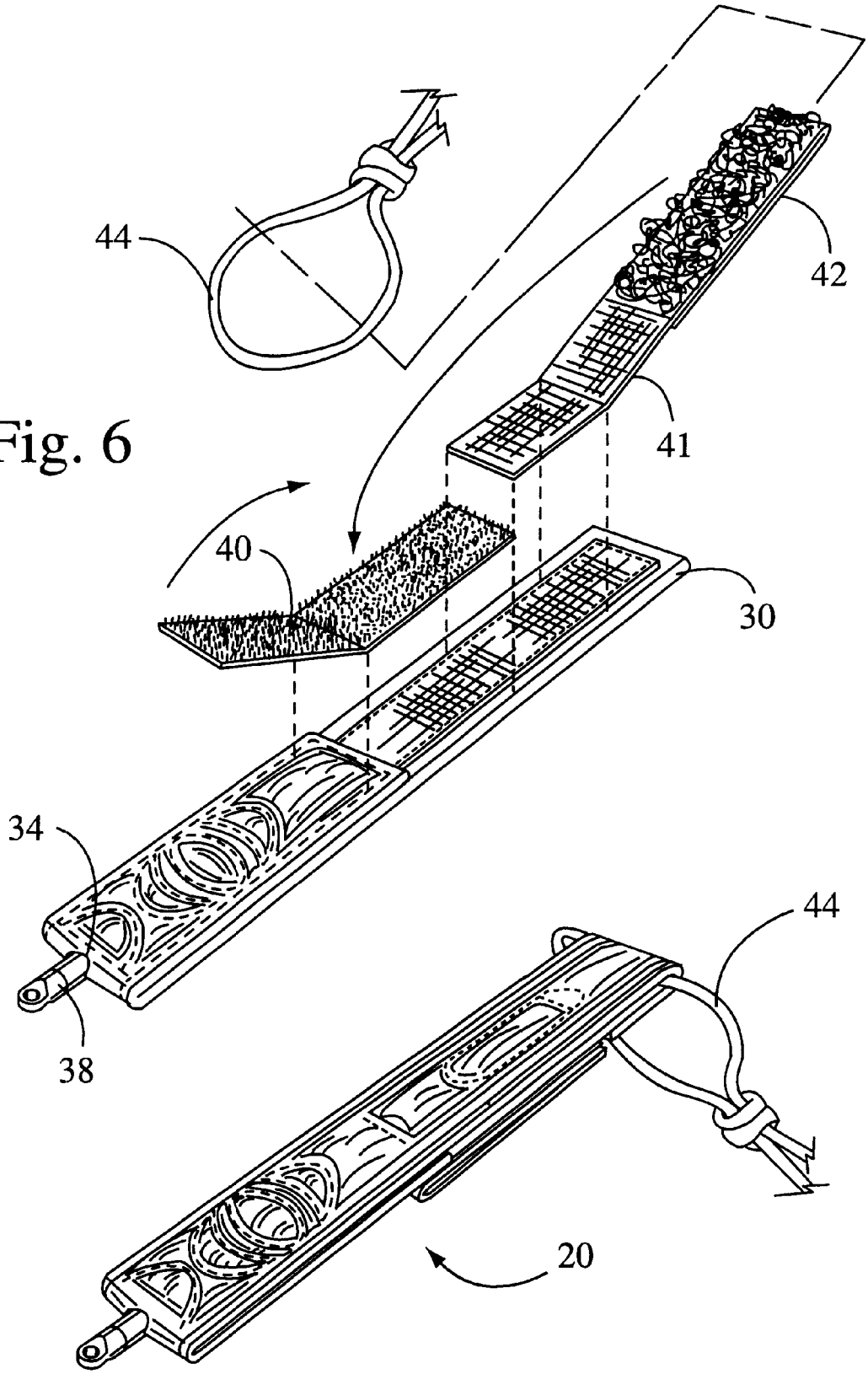
FIG. 7 is a bottom perspective view of a board strap portion of the surf leash shown in FIG. 3.

FIGS. 4–6 illustrate an exemplary method of making the board strap portion 20 shown in FIGS. 3 and 7. As shown in FIG. 4, the board strap portion 20 is primarily made from a cushion strip 30, which is made from a soft resilient material, such as a polymer cell foam material. Preferably, cushion strip 30 is rectangular in shape with a length of about 14-5/16 inches and a width of about 3 inches. Preferably, the cushion strip 30 includes a centrally located raised pattern strip 32. Preferably, the raised pattern strip 32 is about 13-½ inches in length with one end of the raised pattern strip 32 being spaced about 3/16 inch from one end of the cushion strip 30 and the opposite end of the raised pattern strip 32 being spaced about ⅝ inch from the opposite end of the cushion strip 30. Preferably, the raised pattern strip 32 is about one inch in width and is located about one inch from each side of the cushion strip 30.

FIG. 4 illustrates an example of a raised pattern strip. It will be appreciated that many variations are possible. In exemplary embodiments, the raised pattern strip 32 is formed using a heat press process. The heat press process compresses the material that is not part of the raised pattern. In other words, the raised portion of the pattern in pattern strip 32 is the original depth of the cushion strip 30. The indentations in the pattern of pattern strip 32 and the portion of the cushion strip 30 external to pattern strip 32 (e.g., the edges of cushion strip 30) are compressed to a depth which is a fraction of the original depth (e.g., to one-third of the depth from an original depth of about 3/32 inch to about 1/32 inch. Cushion strip 30 includes a hole 34 which may be created using a die cut process. Preferably, the hole is about ¼ inch in diameter and is located about 4-⅝ inches from one end of the cushion strip 30.

As shown in FIG. 5, the cushion strip 30 is placed on a surface (preferably a flat surface) with the inside (foam surface) facing up. A fastening strip 36 which includes a connection device 38 is placed on the raised pattern strip 32 portion of cushion strip 30 such that the connection device 38 lines up with the hole 34. Preferably, connection device 38 is a swivel connector and is preferably constructed of a waterproof metal, such as brass. Connection device 38 is used to connect the board strap portion 20 to the connecting device (e.g., tubing) which connects the board strap portion to the ankle strap portion 50 (shown in FIGS. 8 and 12 and described later). The cushion strip 30 is then folded as shown in FIG. 6. The sides are folded over (to the edges of the raised pattern strip 32) and the end is folded to the hole 34 such that connection device 38 protrudes through the hole 34 and is located at one end of the board strap portion 20 as shown in FIG. 6. The folded cushion strip is then affixed, for example by sewing so that it is permanently in the folded position shown in FIG. 6.

A fastening strip is then attached to the cushion strip 30. Preferably, the fastening strip is adjustable. For example, the fastening strip may be made of a hook and loop fastener, such as VELCRO, as is shown in FIG. 6. The fastening strip shown in FIG. 6 is a VELCRO strip which includes a non-VELCRO portion 41, a VELCRO hook strip portion 40 and a VELCRO loop strip portion 42. The fastening strip holds a board fastening device 44. The board fastening device 44 is secured around the board anchor (bar in the recessed cup). The board fastening device 44 may be a cord, such as is shown in FIG. 6. The fastening strip is attached to the cushion strip 30 (for example by sewing) as shown in FIG. 6 in order to produce the board strap portion 20 of the present invention as shown in FIGS. 3 and 7. Because the board fastening device 44 is attached to the board strap 20 via the adjustable fastening strip, it is easy to detach the surf leash from the surf board. For example, the surf leash can be detached from the surfboard by opening the hook and loop fastener. In contrast, prior art surf leashes were more difficult to detach from the surfboard. For example, prior art surf leashes required untying a knot in order to detach the surf leash.

Figure 9:
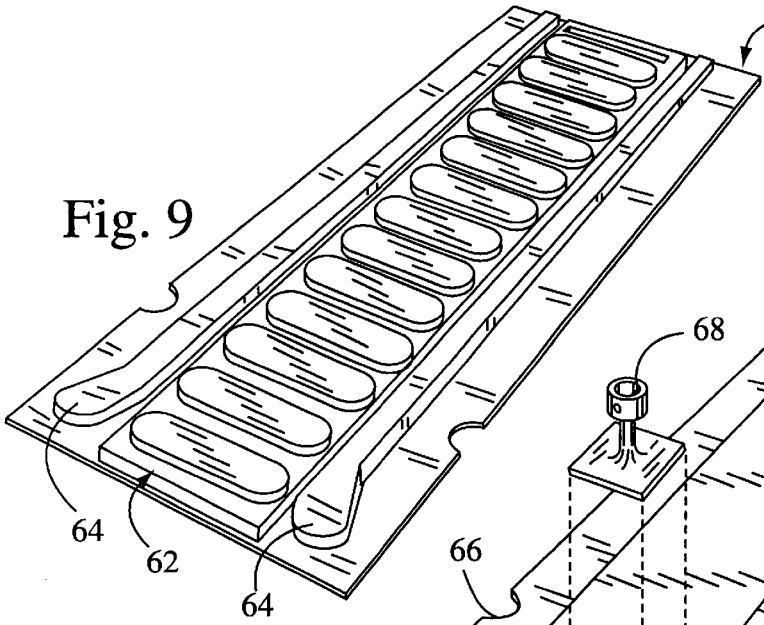
FIGS. 9–11 illustrate steps in making the ankle strap portion of the surf leash shown in FIG. 8.
Figure 10:
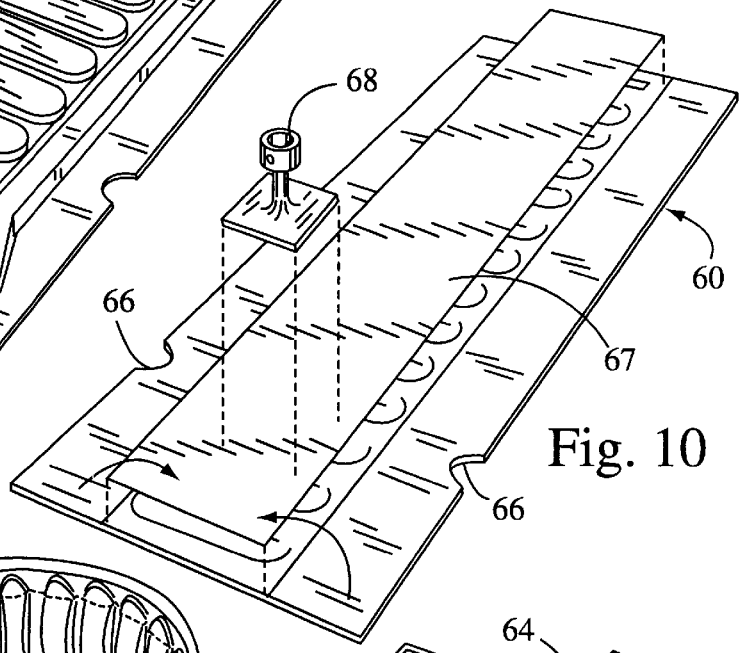
Figure 11:
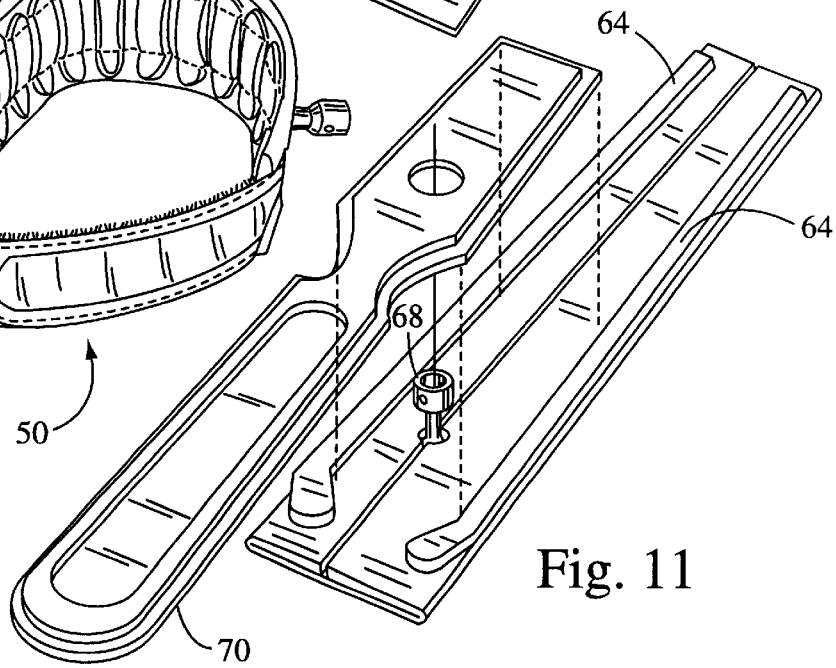

FIGS. 8 and 12 are illustrations of an ankle strap portion 50 formed in accordance with the present invention. FIG. 8 shows the ankle strap portion 50 in its operative condition and FIG. 12 illustrates the ankle strap portion in an extended condition. FIGS. 9–11 show an exemplary method of making ankle strap 50.

Preferably, ankle strap portion 50 is primarily made of a cushion strip 60 which may be made of a polymer cell foam material or a rubber material, such as neoprene. Preferably, the polymer cell foam material has a foam inside and a waterproof fabric outside. In exemplary embodiments, cushion strip 60 is rectangular in shape and has a length of about 10-9/16 inches and a width of about 4-⅝ inches. A cushion section 62 is centrally located along the length of the cushion strip 60. In exemplary embodiments, such as that shown in FIG. 9, the cushion section 62 contains multiple oval shaped cushions. Preferably, the cushion section 62 is about 2-¼ inches wide. Preferably, there are cushion strips 64 located on each side of the cushion section 62. The cushion section 62 and cushion strips 64 are heat pressed to compress the non-pattern portion (for example, from an original depth of 3/16 inch to a depth of 1/16 inch) in the same manner as described above with respect to board strap 20.

As shown in FIG. 10, cushion strip 60 is placed on a surface (preferably a flat surface) with the foam-like portion (inside) facing up. An internal strap portion 67 is placed on cushion strip 60 over the cushion section 62. Preferably, the internal strap portion is a piece of webbing which is rectangular in shape and has a length of about 10 inches and a width of about 1-½ inches. Cushion strip 60 has a notch 66 cut out of each of the lengthwise sides. A connection device holder 68 is placed on the internal strap portion 67 such that the connection device holder 68 is in alignment with the notches 66 of cushion strap 60. In exemplary embodiments, the connection device holder is made of plastic. A connection device (not shown) such as a swivel clip is encased in the connection device holder 68. The cushion strip 60 is folded so that the notches 66 form a hole around the connection device holder 68. As shown in FIG. 11, raised cushion strips 64 are located on each side of the connection piece 68 along the length of cushion strip 60. The cushion strip 60 is affixed in the folded position shown in FIG. 11, for example by sewing.

An adjustment strap is attached to ankle strap portion 50. In exemplary embodiments, such as the one shown in FIG. 12, the adjustment strap employs a hook and loop fastener (e.g., VELCRO). In exemplary embodiments, the adjustment strap includes a strap portion 70 which fits over connection device holder 68. In exemplary embodiments, such as is shown in FIG. 12, the adjustment strap includes a VELCRO hook strip 72 on one end and a VELCRO loop strip 74 at the opposite end. The hook and loop fastener allows the ankle strap to be easily adjusted.

Additional modifications and improvements of the present invention may also be apparent to those of ordinary skill in the art. Thus, the particular combination of parts described and illustrated herein is intended to represent only a certain embodiment of the present invention, and is not intended to serve as a limitation of alternative devices within the spirit and scope of the invention.

What is claimed is:

1. A method of making a surf leash component, the method comprising:

a. placing a surf leash connection piece on a heat pressed cushioned strip;

b. folding the heat pressed cushion strip around the surf leash connection piece such that the surf leash connection piece protrudes from the folded heat pressed cushion strip;

c. securing the folded heat pressed cushion strip in its folded configuration; and d. affixing an adjustable strap to the folded heat pressed cushion strip.

2. The method of claim 1, wherein the surf leash component is a board strap.

3. The method of claim 2, further comprising attaching a board fastening device to the adjustable strap.

4. The method of claim 1, wherein the surf leash component is an ankle strap.

5. The method of claim 1, wherein the heat pressed cushioned strip is made of a polymer foam cell material.

6. The method of claim 1, wherein the heat pressed cushioned strip is made of a rubber material.

7. The method of claim 6, wherein the rubber material is neoprene.

8. The method of claim 1, wherein the adjustable strap employs a hook and loop fastener.

* * * * *